US010774410B2

(12) United States Patent
Savino et al.

(10) Patent No.: US 10,774,410 B2
(45) Date of Patent: Sep. 15, 2020

(54) METHOD OF MANUFACTURING A SPRING WITH IMPROVED THERMAL STABILIZATION

(71) Applicant: Microtechnica S.r.l., Turin (IT)

(72) Inventors: Dario Savino, Palazzolo Vercellese (IT); Giorgio Dante, Turin (IT)

(73) Assignee: MICROTECNICA S.R.L., Turin (IT)

( * ) Notice: Subject to any disclaimer, the term of this patent is extended or adjusted under 35 U.S.C. 154(b) by 72 days.

(21) Appl. No.: 16/030,957

(22) Filed: Jul. 10, 2018

(65) Prior Publication Data

US 2019/0093205 A1 Mar. 28, 2019

(30) Foreign Application Priority Data

Sep. 25, 2017 (EP) ..... 17192902

(51) Int. Cl.

| | |
|---|---|
| ***C22F 1/10*** | (2006.01) |
| ***C21D 9/02*** | (2006.01) |
| ***B21F 3/02*** | (2006.01) |
| *C22C 19/05* | (2006.01) |

(52) U.S. Cl.

CPC ..... *C22F 1/10* (2013.01); *B21F 3/02* (2013.01); *C21D 9/02* (2013.01); *C21D 2261/00* (2013.01); *C22C 19/058* (2013.01)

(58) Field of Classification Search

CPC ..... B21F 3/02; C21D 9/02; C22F 1/10

See application file for complete search history.

(56) References Cited

U.S. PATENT DOCUMENTS

| | | | |
|---|---|---|---|
| 3,311,733 | A | 3/1967 | Bitzer, Jr. |
| 4,245,819 | A | 1/1981 | Bache et al. |
| 6,346,157 | B1 | 2/2002 | Takezawa et al. |
| 8,460,482 | B2 | 6/2013 | Tanimoto et al. |

FOREIGN PATENT DOCUMENTS

| | | | |
|---|---|---|---|
| CN | 102248097 | A | 11/2011 |
| CN | 105033123 | A | 11/2015 |
| KR | 20120133479 | A | 12/2012 |

OTHER PUBLICATIONS

Extended European Search Report for International Application No. 17192902.9 dated Feb. 6, 2018, 17 pages.

*Primary Examiner* — Jessee R Roe

(74) *Attorney, Agent, or Firm* — Cantor Colburn LLP

(57) ABSTRACT

A method for manufacturing a spring is disclosed that comprises: forming the spring from a material; heat treating the spring; performing a first machining step to the ends of the spring; subjecting the spring to a first stress relief heat treatment; performing a second machining step to the ends of the spring; and subjecting the spring to a second stress relief heat treatment step. A spring that is manufactured by this method is also described. This spring may then be used in a pressure relief valve, as well as in other assemblies.

4 Claims, 2 Drawing Sheets

METHOD OF MANUFACTURING A SPRING WITH IMPROVED THERMAL STABILIZATION

FOREIGN PRIORITY

This application claims priority to European Patent Application No. 17192902.9 filed Sep. 25, 2017, the entire contents of which is incorporated herein by reference.

FIELD OF THE INVENTION

This disclosure relates to the field of thermal stabilization of springs that may be used in high temperature applications. The disclosure relates to methods that, in some instances may modify the characteristics of springs that may be used for high temperature pressure relief valves. The disclosure also relates to the manufacture of pressure relieve valve springs. The disclosure also relates to such springs produced via these methods, as well as other components that may benefit from such spring characteristics modification.

BACKGROUND

As is known in the art, high bleed temperature—pressure regulating pneumatic valves are commonly used for many A/C or other heavy duty industrial applications. As A/C application example, environmental control systems (ECS) often comprise valves and wing/engine lip anti-ice valves (ATVs) and the pressure regulation function of these valves is usually performed by means of a pressure relief valve (PRV). The purpose of the PRV is to establish the desired pressure set in a reference chamber (this reference pressure will be thus sensed by a sleeve piston or other mobile elements able to limit the pressure downstream of the main pneumatic valve).

The simplest concept of PRV is constituted by a plunger that is pushed against its seat by a spring. The spring preload is adjusted to reach the desired pressure set-point and when the pressure inside the reference chamber (which is continuously feed by a control orifice) reaches the PRV set-point (i.e. the force on the plunger seat overcomes the spring preload), the plunger displaces, thereby venting the control orifice flow. In this way, the desired reference pressure is established.

It is therefore clear that such PRVs heavily rely on the correct functioning of the spring element. First of all, the spring geometry (mainly in terms of spring faces parallelism) has to be tightly controlled in order to minimize transverse force to the plunger (which in turn causing friction and thus hysteresis on the reference pressure value with respect to upstream bleed pressure variation). Second of all, the spring preload, as well as the spring stiffness should not vary over time in order to guarantee a constant pressure set-point. The control of the combination of these two requirements (i.e. load stability together with tight dimensional control) is particularly challenging considering the high temperature the PRV is exposed to (engine bleed up to 700° C., PRV spring temperature up to 500° C.). Considering these temperatures, PRV springs are currently typically manufactured from Inconel® X750 or other suitable materials.

There is therefore a need to find an improved method of manufacture of these springs, and indeed to provide an improved method of thermally stabilising a material that may be used in this way.

SUMMARY

A method for manufacturing a spring is described herein that comprises forming the spring from a material; heat treating the spring; performing a first machining step to the ends of the spring; subjecting the spring to a first stress relief heat treatment; performing a second machining step to the ends of the spring and subjecting the spring to a second stress relief heat treatment step.

In some of the examples described herein, the first and second machining steps may comprise grinding, or machine grinding the ends or end-coils of the spring.

In some of the examples described herein, the second machining step may be a finer machining step than the first machining step to produce a less coarse surface of the spring ends.

In some of the examples described herein, the material may be a precipitation hardenable Nickel-Chromium alloy with high strength temperatures and high oxidation resistance.

In some examples, the material may be Inconel® X750. Other materials may also be used with this method, however.

In some of the examples described herein, and particularly wherein the material is Inconel® X750, the step of heat treating the spring may comprise heat treating the spring according to condition C, AMS 5699.

In some of the examples described herein, the first stress relief heat treatment may comprise compressing the spring to a length that is reduced compared to the spring's original uncompressed length, via the application of a load and whilst also applying heat.

In some of the examples described herein, the load and heat applied during the stress relief heat treatment step(s) are representative of the most extreme operative conditions of the spring when in use.

In some of the examples described herein, the same load and temperature conditions may be used for both the first and second machining steps.

Any of the methods described herein may be used to manufacture a spring. The spring may also be used in a pressure relief valve.

BRIEF DESCRIPTION OF THE DRAWINGS

Preferred embodiments will now be described by way of example only, with reference to the accompanying drawings.

DETAILED DESCRIPTION

Although the examples described herein with reference to the drawings may be used for, and are described relating to, the manufacture of an Inconel® X750 spring for a high temperature pressure relief valve spring, the improved spring manufacturing techniques described herein may also be used with, or for, any other type of suitable material, spring size, and/or use. The examples described herein with reference to the drawings should therefore not be limited to the specific Inconel® X750 spring described below, or its features and/or properties. For example, the material used to form the spring may be another precipitation hardenable Nickel-Chromium alloy with high strength temperatures and high oxidation resistance. Other materials may also be used that are not nickel-chromium alloys.

For reference purposes only, the examples described below involved the formation and modification of a one type of Inconel® X750 spring that had a free length of 17.34 mm, a wire diameter of 1.9 mm, an outer diameter of 13.8 mm, a stiffness of 19.29 N/mm, a reference assembly load of 25N, a reference assembly working length of 16 mm, faces perpendicularity (with respect to spring axis) of 0.15 mm, faces planarity of 0.2 mm and a face roughness 0.8 μm.

Figure 1:
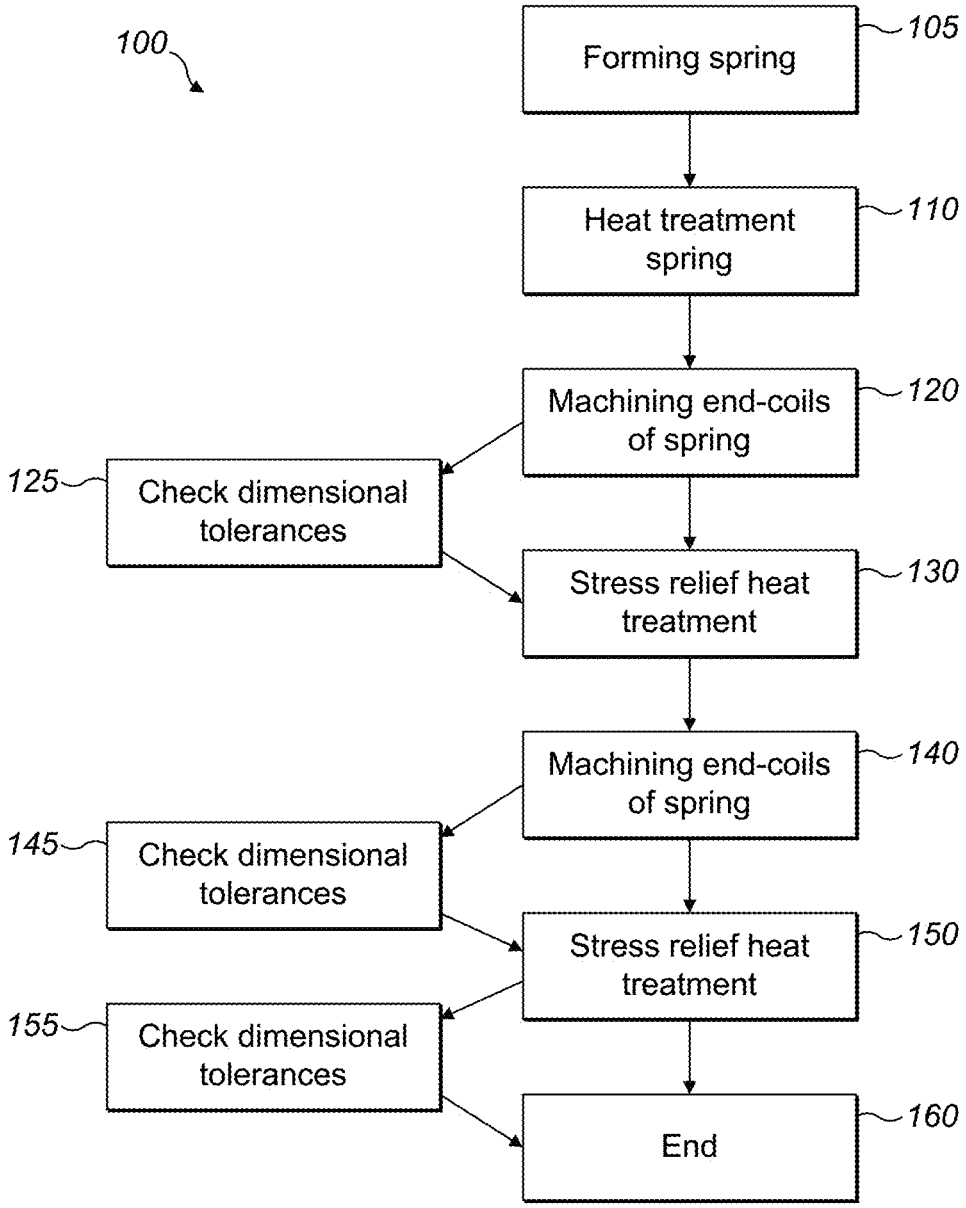
FIG. 1 is a flow diagram of a method of manufacturing a spring using thermal stabilisation.
Figure 2:
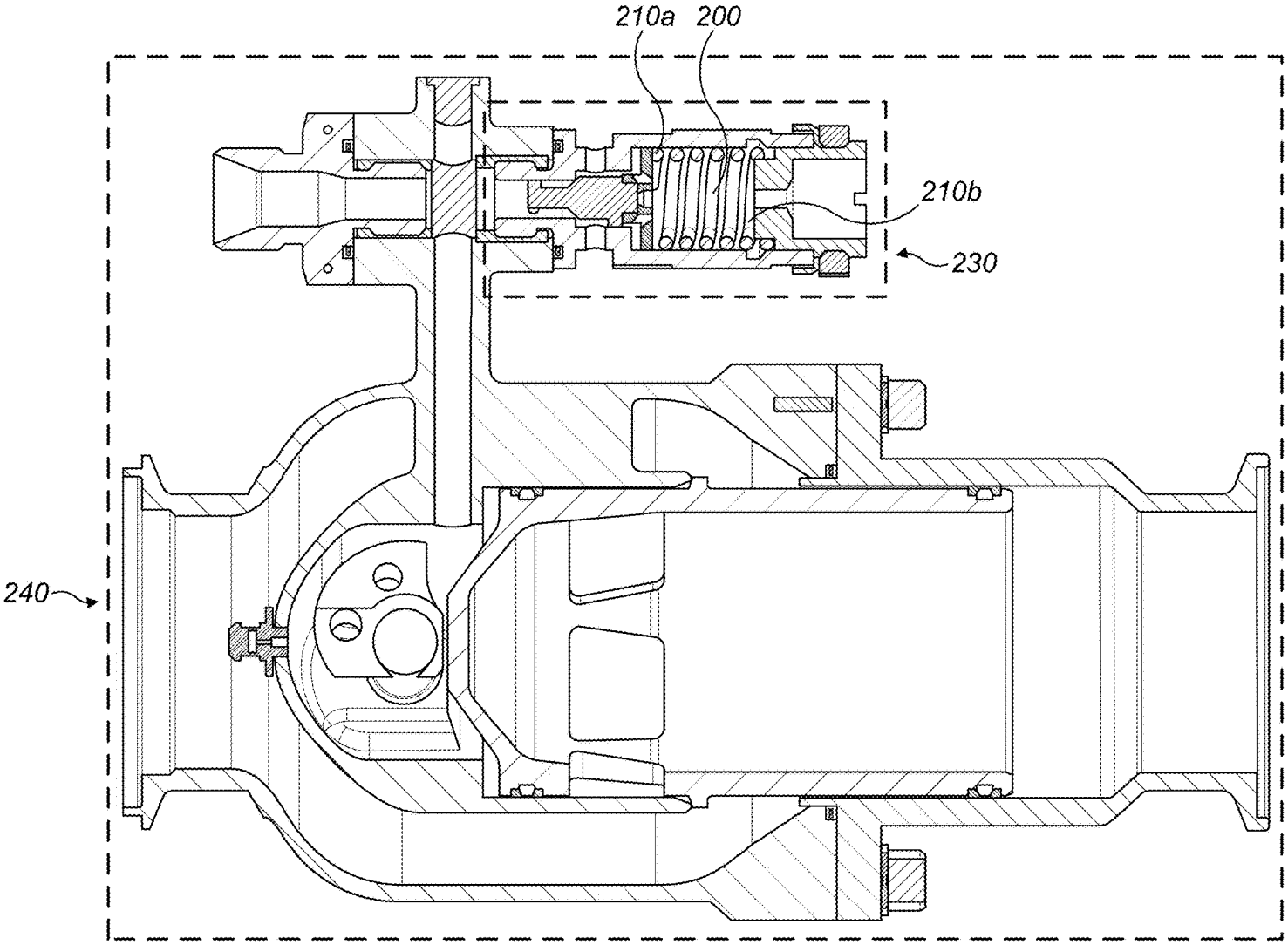
FIG. 2 depicts a perspective view of a spring positioned within a pressure relief valve.

FIG. 2 depicts a spring 200 that is installed within a pressure relief valve 230. Although this FIG. 2 depicts an example of anti-ice valve 240, i.e. a pressure regulating and shut-off valve spring 200, the examples of improved springs described herein could of course also be used in other assemblies and are not limited to this specific relief valve or anti-ice valve arrangement. Such anti-ice valves are known in the art. Indeed, the proposed manufacturing methodology can be applied to springs installed for any application where constant load and precise spring geometry are required.

A new and improved method 100 for manufacturing a spring 200 (e.g. for use in a high temperature pressure relief valve) will now be described with reference to the figures. This new manufacturing method relieves the stress that may be induced during spring end-coil grinding operations, resulting in the guarantee of tight geometric characteristics during the service life of the spring.

The method 100 comprises the steps of first forming 105 the spring 200 from a suitable material. Any conventional methods of forming a spring 200, as are known in the art, may be used. The next method step comprises heat treating 110 the formed spring 200 according to the requirements of that particular material. The heat treatment is performed as prescribed by the applicable material specification. For example, for Inconel® X750; condition C, this is performed according to AMS 5699, as is known in the art. No load is applied during this step. This heat treatment step should be performed prior to the step of machining 120 the ends, or end-coils 210 of the spring 200.

The next step is therefore the machining 120 of the ends, or end-coils 210*a*, 210*b* of the spring 200. In some examples, this may comprise the grinding of the end-coils 210*a,b* using a grinding machine. In some examples, the dimensional tolerances of the spring 200 after this stage may optionally then be checked 125 to confirm that they are approximately three times the dimensional tolerances of the finished item.

The spring 200 is then subjected to a first stress relief heat treatment 130. In this step 130 the spring is compressed to a reduced length via the application of a load. This load should be representative of the most severe operative conditions that the spring 200 is likely to encounter when in use within the valve. During this step 130, the oven temperature should be representative also of the temperature that the spring 200 would be operating under when in use. For example, in one specific example, i.e. in the case of the Inconel® X750 spring described above, the heat treatment may be compressed from a free length of 17.34 mm to a length of approximately 16 mm at a temperature of 530° C. for 24 hours.

Following this step, and after the removal of the heat and load, a second machining step 140 is then performed, wherein the end-coils 210*a, b* of the spring are again machined, for example, via grinding. This second machining step 140 is finer than the first machining step 120 so that the coil-ends 210*a, b* are not as coarse.

After this second machining step 120, in some of the examples described herein, the dimensional tolerances of the spring 200 may optionally also be checked 145 to see if they are the same as for the finished spring. Following this, or following the second machining step 140, a second stress relief heat treatment step 150 is performed. The same load and temperature conditions are used as for the first machining step 120 described above; however, due to the steps performed so far, the spring may compress further under the same load than during step 130 and so the spring 200 may be compressed using the same load so that it now contracts to a length of 15.5 mm when heated to 530° C. for 24 hours. Following on from these steps, the method may then either end 160, or optionally the spring 200 may be checked to make sure the dimensional tolerances of the spring 200 are correct 160, before the method 200 then ends 160.

This manufacturing technique provides numerous benefits over known methods. For example, the spring produced via this method meets the PRV performance requirements in that no hysteresis occurs. The spring also has improved reliability, in that it has a constant pressure set-point throughout its entire working life. It also deals with the issues discussed earlier in the background section of the present disclosure.

Typically, if the second, fine machining step 140 is not performed, then it may not be possible to guarantee repetitive dimensional control (i.e. it would not be possible to guarantee spring faces parallelism). On the other hand, if the step of performing the second stress relief heat treatment 150 does not occur, the spring load may tend to diminish after in-service high temperature exposure (since the end-coils relieve the stress induced during the last machining operation).

The invention claimed is:

1. A method for manufacturing a spring comprises:
forming the spring from a material;
heat treating the spring;
performing a first machining step to the ends of the spring;
subjecting the spring to a first stress relief heat treatment;
performing a second machining step to the ends of the spring;
subjecting the spring to a second stress relief heat treatment step,
wherein said second machining step is a finer machining step than said first machining step to produce a less coarse surface of the spring ends.

2. The method of claim 1, wherein said first and second machining steps comprise grinding.

3. The method of claim 1, wherein said heat treating of said spring comprises heat treating the spring according to condition C, AMS 5699.

4. The method of claim 1, wherein said first stress relief heat treatment comprises compressing the spring to a length that is reduced compared to the spring's original uncompressed length, via the application of a load and whilst also applying heat.

* * * * *